US006307340B1

(12) United States Patent
Wagner et al.

(10) Patent No.: US 6,307,340 B1
(45) Date of Patent: Oct. 23, 2001

(54) METHOD FOR STARTING A POWER LOOM

(75) Inventors: Arno Wagner, Lindenberg; Herbert Mueller, Kressbronn, both of (DE)

(73) Assignee: Lindauer Dornier Gesellschaft mbH (DE)

( * ) Notice: Subject to any disclaimer, the term of this patent is extended or adjusted under 35 U.S.C. 154(b) by 0 days.

(21) Appl. No.: 09/535,276

(22) Filed: Mar. 24, 2000

(30) Foreign Application Priority Data

Mar. 27, 1999 (DE) ..... 199 14 131

(51) Int. Cl.[7] ..... D03D 51/00; H02K 7/02
(52) U.S. Cl. ..... 318/431; 318/161; 139/309
(58) Field of Search ..... 318/161, 430, 318/431; 139/1 E, 304, 309

(56) References Cited

U.S. PATENT DOCUMENTS

| | | | | |
|---|---|---|---|---|
| 3,626,992 | * | 12/1971 | Turner | 139/336 |
| 4,837,485 | | 6/1989 | Meroth et al. . | |
| 5,172,732 | | 12/1992 | Krumm et al. . | |
| 5,617,901 | * | 4/1997 | Adriaen et al. | 139/1 E |
| 5,729,114 | | 3/1998 | Sora et al. . | |

FOREIGN PATENT DOCUMENTS

| | | |
|---|---|---|
| 1535525 | 7/1970 | (DE) . |
| 3542650 | 6/1987 | (DE) . |
| 3733590 | 7/1988 | (DE) . |
| 3921318 | 1/1991 | (DE) . |
| 4445530 | 7/1995 | (DE) . |

* cited by examiner

*Primary Examiner*—Bentsu Ro
(74) *Attorney, Agent, or Firm*—W. F. Fasse; W. G. Fasse

(57) ABSTRACT

A main drive shaft of a power loom reaches the rated operating rpm of the loom by the time of the first beat-up of the reed, thus avoiding start-up faults in the fabric. A flywheel mass is accelerated to a start-up rpm that is higher than the rated operating rpm before it is coupled with the main drive shaft. The start-up rpm is determined automatically and iteratively, with ever-increasing accuracy in successive starts of the loom. When the main drive shaft is coupled to the flywheel mass, the flywheel mass rpm decreases simultaneously as the main drive shaft rpm increases from standstill to the operating rpm. The actual main drive shaft rpm is measured at least at the time of the first beat-up and any deviation from the rated operating rpm is evaluated by the loom control. After each start-up, a new data set is generated based on the measured values and is used to calculate an updated or modified flywheel start-up rpm in the next start-up operation so that the main drive shaft more accurately reaches at least the rated operating rpm by the time of the first beat-up of the reed.

23 Claims, 1 Drawing Sheet

METHOD FOR STARTING A POWER LOOM

PRIORITY CLAIM

This application is based on and claims the priority under 35 U.S.C. §119 of German Patent Application 199 14 131.2, filed on Mar. 27, 1999, the entire disclosure of which is incorporated herein by reference.

FIELD OF THE INVENTION

The invention relates to a method of starting a power loom equipped with an electric main drive. In such a loom the main drive drives at least one flywheel mass that is coupled to the main drive and is coupled to a main drive shaft by a clutch.

BACKGROUND INFORMATION

It is customary to drive power looms by an electric motor that is connected to an a.c. power supply or a three-phase power supply network. Preferably, pole-switchable or frequency-controlled motors are used. The main power drive is coupled by power transmission means, such as a belt and pulley drive, to a flywheel mass which is coupled to the main drive shaft of the loom, whereby the electric motor drives the flywheel mass. Prior art systems are so constructed that following the switching-on of the main drive, the flywheel mass is first accelerated by the motor to a predetermined rotational speed (called "rpm" herein for brevity). For starting the loom itself, a clutch-brake unit is used for coupling the flywheel mass to the main drive shaft of the loom, so that the rotating flywheel mass starts the loom from a standstill. The performance characteristic of the clutch the "stiffness" or stability of the motor, and the size of the effective flywheel mass, as well as friction resistances determine a very specific rotational speed or rpm progression characteristic on the one hand for the flywheel mass and on the other hand for the main drive shaft of the loom during the loom start-up process. The rpm of the flywheel mass drops substantially after the clutch is engaged and continues to drop until it matches the rpm of the main drive shaft of the loom that is accelerating from a standstill. During this process, the rpm difference between the main loom drive shaft and the flywheel mass involves the "slipping" of the clutch as it is engaged.

Start-up systems for the looms of the type mentioned above must satisfy special conditions in practice. For example, it is necessary that the loom be completely coupled to its power drive before the first beat up of the reed. It can happen during such a coupling operation that the main loom drive shaft is completely coupled to the power drive before the first reed beat-up, but that the instantaneous rotational speed of the loom is too low at the first reed beat-up. As a result, so-called start-up faults are formed in the fabric. Such start-up faults are formed at places where the inserted weft thread is not beat-up with sufficient force against the beat-up edge of the fabric, resulting in an enlarged spacing between neighboring threads. A series of such enlarged spacings resulting from improperly beat-up weft threads may show up as a stripe-type fabric fault. In order to avoid start-up faults that result from insufficient rotational speed in the start-up phase of the loom, it has been customary heretofore to try to construct the loom drive in such a way that it reaches the desired final instantaneous rotational speed if possible by the time of the first beat-up of the reed.

Such a method for starting up a main drive of a power loom is known from U.S. Pat. No. 4,837,485 (Meroth et al.), which issued to the applicant of the present application. The entire disclosure of U.S. Pat. No. 4,837,485 is incorporated herein by reference. While the system and method of U.S. Pat. No. 4,837,485 are effective for achieving the intended objects thereof, there is still room for further improvement. One shortcoming of the method disclosed therein is that it does not call for precisely determining how much the rated rpm of the main power drive, and thus the rpm of the flywheel mass, must be increased in order for the main loom drive shaft to reach the rated operating rpm by the time of the first beat-up of the reed after the main power drive has coupled with the main loom drive shaft. Instead, the prior method generally involves isolating or disconnecting the main power drive from the power supply network during the coupling operation and then reconnecting it to the network with a greater number of motor poles, for example, in order to select a specific rpm that lies between the starting rpm in the coupling operation and the rated rpm for the weaving operation.

SUMMARY OF THE INVENTION

In view of the above it is an object of the invention to provide a method of starting a loom so as to automatically ensure that the rated rpm of the loom is reached by the first reed beat-up. More particularly, the invention aims to provide such a method involving automatically determining the start-up rpm of a flywheel mass that is necessary to accelerate the main drive shaft of a loom to the rated rpm for a weaving operation, following a loom standstill, by the time of the first beat-up of the reed. It is a further aim of the invention to provide such a method that is self-learning, that is, will iteratively determine with increasing accuracy the start-up rpm that is required for the main drive shaft to reach the rated rpm by the time of the first reed beat-up. The invention also aims to overcome or avoid the disadvantages of the prior art, and to achieve additional advantages, as are apparent from the present specification.

The above mentioned objects of the invention have been achieved according to the invention in a method of starting a power loom. The method involves calculating or determining a start-up rpm for a flywheel mass for the start-up operation of the power loom so that the rpm of the flywheel mass and the main drive shaft of the loom are both at approximately the rated operational rpm for the weaving operation at the time the main drive shaft is completely coupled to the flywheel mass, before the time of the first reed beat-up. The method measures the rpm of the main drive shaft of the loom at least at the time of the first beat-up of the reed; determines the deviation of the measured rpm from the rated rpm; evaluates and stores the measured values in the loom control; and calculates a new start-up rpm for the start-up operation, based on the determined values, such that in a subsequent start-up of the loom following a standstill, the speed of the main drive shaft will reach the rated rpm with better accuracy at least by the time of the first beat-up of the reed.

It is significant according to the invention that the rpm of the loom main drive shaft is measured at least at the first beat-up of the reed and the deviation of the measured rpm from the rated rpm is determined. At each new start-up of the loom, the deviation of the measured rpm relative to the rated rpm is evaluated and a new data set with a new start-up rpm is generated and stored to be used for the next subsequent start-up operation. In other words, in each start-up operation, the flywheel mass is accelerated to the respective start-up rpm that was determined in the preceding start-up operation, whereby each successively determined start-up rpm is improved relative to the prior value so as to successively improve the accuracy of getting the main drive shaft up to the rated rpm by the time of the first reed beat-up, without "wasting" time and energy in over-accelerating the flywheel to an excessively high start-up rpm.

Thus, the method according to the invention can be designated as a self-learning method of starting up a loom. With each start-up of the loom subsequent to a fault interruption, data points that map the running-up of the loom rpm from a standstill to the time of the first beat-up or during the course of several beat-ups are generated and stored in the loom control. The actual start-up rpm of the drive motor or of the flywheel mass that is necessary for ensuring that the main drive shaft of the loom will reach the rated rpm at the time of the first beat-up of the next start-up operation is calculated, based on these increasingly accurate data points.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
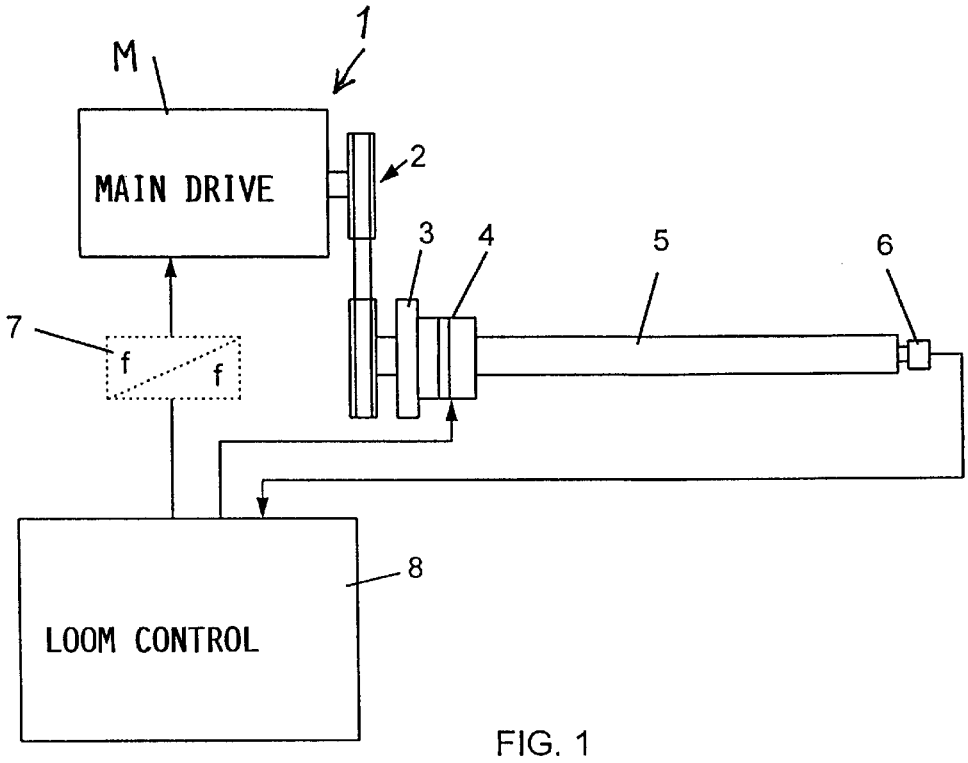
FIG. 1 is a schematic diagram of the drive arrangement of a power loom, suitable for carrying out the present inventive method.

FIG. 1 shows the general structure of a main drive 1 of a power loom. Conventionally, the main drive 1 includes an electric motor M, a power transmission 2, a flywheel mass 3, and a coupling arrangement, which in the presently described embodiments of the invention is a clutch-brake unit 4. The electric motor 1 is preferably a pole-switchable or frequency-controlled electric motor that is controlled by a loom control 8 and connected to an a.c. power supply network or grid for its power. If the main drive 1 includes a frequency controlled motor, then a frequency converter 7, shown in FIG. 1 with broken lines, is required to convert the rated frequency predetermined by the loom control 8 to the frequency necessary to operate the motor M at the respective desired speed and to provide the necessary operating power.

The electric motor M drives the flywheel mass 3 via the power transmission 2, which can be a belt and pulley drive, as shown in FIG. 1. The flywheel mass 3 is decouplable via the clutch-brake unit 4 to a main drive shaft 5 of the loom. The particular embodiments of the main drive 1 and the construction of the drive path from the motor M to the main drive shaft 5 are generally known and are not described herein in detail. Reference should be made to U.S. Pat. No. 4,837,485, for example. The components of the main drive used in the present inventive method can be selected from any available known prior art components of a loom main drive.

Further according to the invention, a signal emitter 6 is arranged on or near the main drive shaft 5 so as to measure the rotational speed (e.g. the "rpm") of the shaft 5. The signal emitter 6 can be embodied as a tachometer, for example, and can transmit the instantaneous rpm of the main drive shaft 5 to the M loom control 8. The loom control 8 in turn controls the motor M as described above, and the clutch-brake unit 4 so as to selectively couple the flywheel mass 2 to or decouple the flywheel mass 3 from the drive shaft 5.

Figure 2:
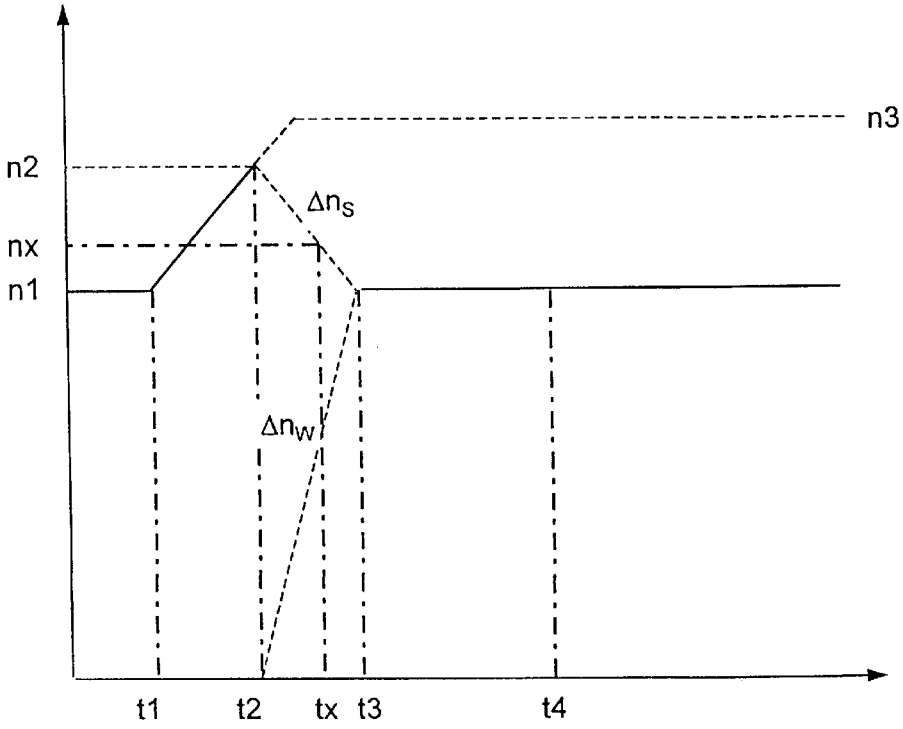
FIG. 2 is a diagram of the progressions of the rpm of the flywheel and of the main shaft respectively, during the start-up phase of a power loom.

In the following discussion of the operation of the method according to the invention as shown in FIG. 2, it will be assumed that the loom operation has been automatically interrupted, for example due to a fault, and that the main drive 1 is idling or running in a no-load condition. In other words, the clutch-brake unit 4 has decoupled the main drive shaft 5 of the loom from the flywheel mass 3, and the main drive shaft 5 is at a standstill.

The start-up operation of the loom will first be described for an example embodiment of the main drive 1 that has a pole-switchable selectable speed motor M. When operating with a higher number of active poles, the motor M operates at a normal rpm, which corresponds to the rated operating speed or rpm nl of the flywheel mass 3 and of the main drive shaft 5. When operating with a lower number of active poles, the motor M operates at its highest rpm, which corresponds to a highest flywheel rpm n3 of the flywheel mass 3.

To start-up the loom after a fault has been eliminated, the loom control 8 causes the number of active poles of the motor M to be switched to the lower number of poles at time t1, as shown in FIG. 2. This causes the motor M to accelerate from its normal rpm (corresponding to the rated operating rpm n1) to its highest rpm. The flywheel mass 3, running in the no-load condition, is thus also accelerated from the rated operating rpm to a respective corresponding higher start-up rpm. It is essential to the invention that the flywheel mass 3 be accelerated to an rpm that is higher than the rated operating rpm n1 for the respective weaving operation. Generally, however, it is not necessary to accelerate the flywheel mass 3 to the full limit of the highest rpm n3, and an advantageous start-up rpm generally lies between the rated operating rpm n1 and the highest flywheel rpm n3.

Once the flywheel mass 3 has reached the respective prescribed start-up rpm n2, which is the case at time t2, the loom control 8 isolates or disconnects the motor M from its power supply so that the motor M no longer supplies power to the main drive 1 and instead simply freewheels. The inertial mechanical energy stored in the flywheel mass 3 is the only energy that is now effective in the main drive 1. The clutch-brake unit 4 is now actuated by the loom control 8, preferably simultaneously with the above mentioned power disconnection of the motor M, whereby the flywheel mass 3 is coupled with the main drive shaft 5 of the loom.

Then, as can be seen in FIG. 2, the rpm or rotational speed of the flywheel mass 3 decreases along a dashed line $\Delta n_s$ from its start-up rpm n2 at time t2 to approximately the rated operating rpm n1 at time t3. At the same time, the rpm or rotational speed of the main drive shaft 5 of the loom increases along dashed line anw from a standstill at time t2 to an rpm corresponding to approximately the rated operating rpm n1 at time t3. Once the main drive shaft 5 is completely coupled to the main drive 1, the rpm of the flywheel mass 3 and the rpm of the main drive shaft 5 are at the same speed approximately equal to the rated operating rpm, shown at time t3.

According to the invention, the time t3 is so selected (by proper operation of the clutch-brake unit 4) that the time t3 substantially coincides with the time of the first reed beat-up of the loom. Moreover, the start-up rpm n2 is so selected that the mutual rpm of the flywheel mass 3 and the main drive shaft 5 are substantially equal to the desired rated operating rpm n1. Since the start-up rpm n2 at time t2 is initially higher than the rpm that corresponds to the rated operating speed at the time of the first beat-up of the reed, the rpm speeds of the flywheel mass 3 and the main drive shaft 5 are adapted to each other from time t2 to time t3 to achieve an operating speed at time t3 in a range that corresponds to the desired rated operating rpm n1 for the loom operation. For example, the actual operating speed at time t3 is within +4% of the rated operating rpm value n1. As a result, the rpm of the main drive shaft 5 is already high enough at the time of the first beat-up of the reed to ensure that the first weft thread is beat-up with practically full force, thereby avoiding start-up faults in the fabric.

As previously mentioned, in this example embodiment in which the main drive 1 is driven by a pole-switchable motor M, preferably no drive energy other than the mechanical energy of the rotating flywheel mass 3 is provided during the time of this start-up phase of operation, i.e. the time between start-up of the loom and the first beat-up of the reed. Then, at time t3, the motor N is again connected to its electric power supply to operate at the rated operating rpm n1.

Alternatively, the motor M can be switched on in its normal operating mode, i.e. with its higher number of poles, during the coupling phase of matching the rpm of the flywheel mass 3 to that of the main drive shaft 5 between times t2 and t3. The motor M is then electrically driven to operate at its normal rpm that corresponds to the rated operating rpm n1. This can be carried out, for example, at a time tx when the rotational speed of the flywheel mass 3 has been reduced to a certain threshold or trigger rpm nx slightly higher than the rated operating rpm n1 of the loom, as shown in FIG. 2.

As a further alternative, the motor M can be switched on to be electrically driven with the normal rpm that corresponds to the rated operating rpm n1 immediately after the main drive shaft 5 has been coupled to the flywheel 3. In other words, at time t2, the motor M is switched directly from operating with the lower number of active poles to operating with the higher number of active poles. This alternative is provided particularly for the case when the main drive shaft 5 must be coupled to the flywheel 3 at the highest possible rpm, because the rated operating rpm n1 would not otherwise be reached.

At time t3, that is, at the first beat-up of the reed, the signal emitter 6 measures and emits a signal corresponding to the instantaneous rpm of the main drive shaft 5. The measured rpm signal is transmitted by the signal emitter 6 to the loom control 8, where the signal is detected, evaluated to the extent necessary, and compared with the rated operating rpm n1 to determine any deviation between the measured rpm value and the rated operating rpm n1. In this context, the rated operating rpm n1 may be supplied to the loom control 8 as an operator input for example, or may have been previously stored in the loom control 8. If necessary, the rpm of the main drive shaft 5 can be measured several times during the time period between the time t2 and time t3, thereby obtaining a more accurate map of the progression of the rpm of the main drive shaft 5 during the start-up operation.

Based on the measured rpm value or values obtained during the start-up operation and especially the deviation of the measured rpm value from the rated operating rpm n1 at time t3, and based on the start-up rpm that was used in the just-measured start-up operation, the loom control 8 calculates a revised value of the start-up rpm n2 that is required in the next start-up operation in order to ensure that the main drive shaft 5 reaches (or at least more closely matches) the rated operating rpm n1 at the time t3 of the first beat-up of the reed. The rpm which the main drive shaft 5 shall reach by the time of the first reed beat-up can be referred to as the "target rpm". The calculations to determine the next start-up rpm n2 are based on a calculation of the required start-up energy, which is essentially dependent on the mass "m", the effective diameter "D", and the rpm "n" of the flywheel mass 3. The overall dynamics of the drive must, of course, be properly sized for the particular application.

The particular details of carrying out the determination or calculation of the revised value of the start-up rpm can be in accordance with any known method and using any known hardware and software that are capable of achieving such a calculation or determination. For example, the measured values (such as the actual measured shaft rpm from the prior start-up cycle) and the operator input values (such as the rated operating rpm to be used for the upcoming start-up cycle) can be "plugged" into a suitable functional expression, which is then mathematically evaluated to yield the revised value of the start-up rpm. Alternatively, the revised value can be looked up from a table or other memory structure containing pre-specified possible values for the startup rpm based on the variables and input parameters discussed herein. As a further alternative, the revised value for the start-up rpm can be determined based on extrapolation or interpolation from values of the prior start-up cycle or cycles. Another alternative is to generate the revised value with a logic circuit, for example using fuzzy logic, that determines a most likely ideal revised value of the start-up rpm based on the experience data obtained in the prior start-up cycle or cycles as well as the various input parameters. In any event, the determination takes into account what actual rpm was achieved by the main drive shaft at the time of the first reed beat-up as a result of using the prior start-up rpm for the flywheel mass. If the actual shaft rpm was lower than the desired target rpm (e.g. the rated operating rpm), then the revised value of the start-up rpm will be accordingly increased in accordance with the particular determination method, and vice versa. Before the loom is used for production weaving, it is preferable to run through a few start-up cycles in order to calibrate the start-up rpm. Then, when the loom begins production operation, the actual shaft rpm attained by the main drive shaft will be expected to closely match the desired target rpm at the time of the first reed beat-up. The hardware and/or software for carrying out the determination may involve general known modules such as a comparator, a memory, and mathematical functions such as a multiplier, summer, divider, etc., or any other known circuitry included in conventional loom controllers.

When the loom is restarted following an interruption due to a fault for example, the flywheel mass 3 is brought up to the start-up rpm n2 that was last calculated prior to this standstill of the loom, and the start-up operation is carried out with this new corrected or updated rpm n2. With each successive start-up, therefore, the loom is run-up with a new value of the start-up rpm n2 that is based on the last data set that was calculated prior to the standstill, and a new data set is generated based on the measured rpm values from the current start-up operation for use in calculating a new, further corrected start-up rpm n2 for the next start-up operation. Thus, each successive start-up operation iteratively improves on the accuracy with which the actual measured rpm of the main drive shaft 5 reaches or matches the desired rated operating rpm n1 at the time t3. Also, as the start-up rpm progression of the loom varies over time (e.g. due to component wear, or as time progresses between maintenance intervals), the new calculation of an updated start-up rpm n2 in each successive start-up operation will automatically enable the successive values of the start-up rpm n2 to track and compensate for such variations of the start-up performance of the loom.

In a second example embodiment according to the inventive method, the main drive 1 for the power loom comprises and is driven by a frequency controlled motor M. A respective rated operating rpm n1 for the flywheel mass 3 is generated by feeding the specified rated frequency f to the motor M through the frequency converter 7.

To start up the loom after eliminating a fault, for example, the loom control 8 feeds a higher operating frequency that is supplied by the frequency converter 7 to the motor M at time t1. This results in an increased rpm of the motor N and, accordingly, the flywheel mass 3 is accelerated from an idle or no-load condition to the respective increased rpm n2. Once the flywheel mass 3 has reached the specified start-up rpm n2, which is the cage at time t2, then the clutch-brake unit 4 is actuated and the flywheel mass 3 is coupled with the main drive shaft 5 of the loom. As shown in FIG. 2, the rpm or rotational speed of the flywheel mass 3 decreases along the dashed line $\Delta n_s$ from its rpm value n2 at time t2, while the rpm or rotational speed of the main drive shaft 5 increases along the dashed line $\Delta n_w$ from its standstill at time t2. The rpm of the flywheel mass 3 and the rpm of the main drive shaft 5 have the same value at time t3, after complete coupling has been achieved through the clutch-brake unit 4. The time t3 is selected such that it coincides with the time of the first beat-up of the reed of the loom, as described above. Because the start-up rpm n2 of the flywheel mass 3 is selected at an initially higher speed than the rated operating rim ni, the respective rpm speeds of the flywheel mass 3 and of the main drive shaft 5 are adapted to each other from time t2 to achieve an operating speed at time t3 that lies within the desired operating range of the rated operating rpm n1. Namely, the operating rpm actually achieved at time t3 is only slightly above or below this rated value n1, In this way, the rpm of the main drive shaft 5 is already high enough at the time of the first reed beat-up that the first weft thread is beat-up with practically full force.

After the main drive shaft 5 and the flywheel mass 3 are coupled, the loom control 8 calculates the new updated start-up rpm n2 generally as described above. In the present second embodiment, the loom control 8 particularly calculates the necessary modification of the specified frequency f to be supplied to the motor M by the frequency converter 7. The modification is calculated dependent on the angle of rotation of the main drive shaft 5 at start-up and the angle of rotation achieved by the main drive shaft 5 at the time of the first reed beat-up, so as to reach the rated operating rpm n1 by the time of the first beat-up of the reed with the smallest possible deviations.

At time t3, that is at the first beat-up, the signal emitter 6 measures and emits a signal corresponding to the actual rpm of the main drive shaft 5. This measured signal is received and evaluated to the extent necessary in the loom control 8, which then determines a deviation of the measured rpm from the rated operating rpm n1. As mentioned above, additional measurements of the main drive shaft rpm can be carried out before the first beat-up of the reed. The loom control 8 calculates from these values the necessary start-up rpm n2 of the flywheel mass 3 at time t2 of the coupling operation and also the progression of the specified frequency supplied by the frequency converter 7 to the motor M, so that in a new start-up the rated operating rpm n1 is reached as accurately as possible at the first beat-up of the reed. In a new start-up of the loom, the flywheel mass 3 is brought up to the corrected or updated start-up rpm n2 that was calculated in the preceding start-up operation, and the start-up operation is carried out with this corrected rpm. With each new start-up, the loom is run up with the data that was calculated in the preceding start-up operation and a new data get for the next subsequent start-up operation is generated.

The first start-up of the loom, before an updated start-up rpm is calculated according to the inventive method, can be carried out using a nominal or generally applicable start-up rpm for the flywheel mass. The inventive method then successively improves on that nominal or general start-up rpm.

When operating the loom with a frequency-controlled motor M, the motor M and the flywheel mass 3 can already be operated at idle or no-load condition at the specified start-up rpm n2. The start-up operation of the loom can then begin immediately at time t2.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method of starting a power loom having a main drive shaft and a flywheel that is selectively coupleable to and uncoupleable from said main drive shaft, comprising the following steps:

a) providing a target rpm at which said main drive shaft is to be rotating at a first beat-up time of a first reed beat-up;

b) providing a start-up rpm at which said flywheel is to be rotating at a coupling time of commencing to couple said flywheel to said main drive shaft;

c) rotating said flywheel at said start-up rpm;

d) when said flywheel is rotating at said start-up rpm, commencing to couple said flywheel to said main drive shaft at said coupling times and thereby rotating and accelerating said main drive shaft;

e) after said step d), measuring an actual shaft rpm of said main drive shaft respectively at at least one measurement time not later than said first beat-up time;

f) determining any existing deviation of said actual shaft rpm from said target rpm;

g) based at least on said deviation, determining a revised value of said start-up rpm;

h) decoupling said main drive shaft from said flywheel and stopping said main drive shaft; and i) using said revised value for said start-up rpm, repeating at least each of said steps b), c), d), e) and f) to again start said loom;

wherein said determining of said revised value of said start-up rpm in said step g) is carried out such that said deviation determined in repeating said step f) in said step i) is smaller than said deviation determined in the prior performance of said step f).

2. The method according to claim 1, wherein said at least one measurement time in said step e) comprises a measurement time coincident with said first beat-up time.

3. The method according to claim 1, wherein said at least one measurement time in said step e) comprises a plurality of measurement times after said coupling time and not later than said first beat-up time, and said measuring of said actual shaft rpm comprises generating successive actual shaft rpm values respectively at said measurement times.

4. The method according to claim 1, wherein said step e) further comprises measuring another actual shaft rpm of said main drive shaft at at least one additional measurement time after said first beat-up time.

5. The method according to claim 1, wherein said step of providing said target rpm comprises setting said target rpm equal to a rated operating rpm at which said main drive shaft is to rotate for carrying out a weaving operation.

6. The method according to claim 1, wherein said step of providing said target rpm comprises setting said target rpm to a value greater than a rated operating rpm at which said main drive shaft is to rotate for carrying out a weaving operation.

7. The method according to claim 1, wherein said actual shaft rpm measured in said repeating of said step a) in said step i) is at least 96% of a rated operating rpm at which said main drive shaft is to rotate for carrying out a weaving operation.

8. The method according to claim 1, wherein said determining of said deviation in said step f) and said determining of said revised value of said start-up rpm in said step g) comprises evaluating said measured actual shaft rpm to provide evaluated values and storing said evaluated values in a loom controller of said power loom.

9. The method according to claim 1, wherein said power loom further includes a multi-pole electric motor with a switchable number of active poles and with a minimum motor speed corresponding to a rated operating rpm at which said main drive shaft is to rotate for carrying out a weaving operation;

wherein said step of rotating said flywheel comprises switching an active number of poles of said motor to operate said motor at a higher motor speed that is higher than said minimum motor speed, and rotationally driving said flywheel with said motor to accelerate said flywheel to said start-up rpm; and wherein said method further comprises disconnecting said motor from an electric power supply at said coupling time, and then switching said active number of poles of said motor and reconnecting said motor to said electric power supply to operate said motor at said minimum motor speed at a time not later than said first beat-up time.

10. The method according to claim 1, wherein said power loom further includes an electric motor connected to said flywheel and adapted to rotationally drive said flywheel;

wherein said step of rotating said flywheel comprises accelerating said flywheel to said start-up rpm by rotationally driving said flywheel with said motor set to a first motor speed; and wherein said method further comprises switching said motor to a second motor speed immediately following said coupling time, wherein said second motor speed is lower than said first motor speed and adapted to rotationally drive said flywheel at a rated operating rpm at which said main drive shaft is to rotate for carrying out a weaving operation.

11. The method according to claim 1, wherein said power loom further includes an electric motor connected to said flywheel and adapted to rotationally drive said flywheel;

wherein said step of rotating said flywheel comprises accelerating said flywheel to said start-up rpm by rotationally driving said flywheel with said motor set to a first motor speed; and wherein said method further comprises switching said motor to a second motor speed at a time between said coupling time and said first beat-up time, when said main drive shaft is rotating at a threshold trigger rpm (nx), wherein said second motor speed is lower than said first motor speed and adapted to rotationally drive said flywheel at a rated operating rpm at which said main drive shaft is to rotate for carrying out a weaving operation.

12. The method according to claim 1, wherein said power loom further includes a variable-speed frequency-controlled electric motor with a minimum motor speed approximately equal to a rated operating rpm at which said main drive shaft is to rotate for carrying out a weaving operation; and wherein said step of rotating said flywheel comprises operating said motor at a selected drive frequency so as to rotationally drive and accelerate said flywheel to said start-up rpm.

13. The method according to claim 12, wherein said method further comprises operating said motor while adjusting said selected drive frequency between said coupling time and said first beat-up time, wherein said adjusting is carried out dependent on at least a starting rotational angle of said main drive shaft at said coupling time and a respective actual rotational angle of said main drive shaft at a time of said adjusting.

14. The method according to claim 1, wherein said repeating of said step c) is automatically initiated upon the performance of said step h).

15. The method according to claim 1, wherein said step i) is carried out so as to ensure that said actual shaft rpm at said first beat-up time is at least equal to a rated operating rpm at which said main drive shaft is to be operating to carry out a weaving operation.

16. A method of restarting a power loom having a main drive shaft, a loom control, a main power drive that includes an electric motor, at least one flywheel mass that is connected to said main power drive and a selectively engageable coupling that selectively couples said flywheel mass to said main drive shaft, said method comprising the following steps:

a) providing a start-up rpm for said flywheel mass;

b) providing a rated operating rpm at which said main drive shaft is to be operating at a first beat-up time of a first reed beat-up;

c) rotating said flywheel mass at said start-up rpm;

d) when said flywheel mass is rotating at said start-up rpm, commencing to couple said flywheel mass to said main drive shaft at a coupling time and thereby rotating and accelerating said main drive shaft;

e) measuring an actual main drive shaft rpm of said main drive shaft respectively at at least one measurement time not later than said first beat-up time;

f) determining any existing deviation of said actual main drive shaft rpm from said rated operating rpm;

g) based at least on said deviation, determining a revised value of said start-up rpm for a subsequent start-up operation of said loom, wherein said start-up rpm is calculated such that said main drive shaft rpm is substantially equal to said rated operating rpm at least at said first beat-up time.

17. The method according to claim 16, wherein said electric motor is a multi-pole electric motor with a switchable number of active poles and with a minimum motor speed corresponding to said rated operating rpm at which said main drive shaft is to rotate for carrying out a weaving operation;

wherein said step of rotating said flywheel mass comprises switching an active number of poles of said motor to operate said motor at a higher motor speed that is higher than said minimum motor speed, and rotationally driving said flywheel mass with said motor to accelerate said flywheel mass to said start-up rpm; and wherein said method further comprises disconnecting said motor from an electric power supply at said coupling time, and then switching said active number of poles of said motor and reconnecting said motor to said electric power supply to operate said motor at said minimum motor speed at a time not later than said first beat-up time.

18. The method according to claim 16, wherein said electric motor is a variable-speed frequency-controlled electric motor with a minimum motor speed approximately equal to said rated operating rpm at which said main drive shaft is to rotate for carrying out a weaving operation; and wherein said step of rotating said flywheel mass comprises operating said motor at a selected drive frequency so as to rotationally drive and accelerate said flywheel mass to said start-up rpm.

19. The method according to claim 18, wherein said method further comprises operating said motor while adjusting said selected drive frequency between said coupling time and said first beat-up time, wherein said adjusting is carried out dependent on at least a starting rotational angle of said main drive shaft at said coupling time and a respective actual rotational angle of said main drive shaft at a time of said adjusting.

20. The method according to claim 16, wherein said actual main drive shaft rpm is at least 96% of said rated operating rpm at which said main drive shaft is to rotate for carrying out a weaving operation.

21. The method according to claim 16, further comprising the step of switching on said electric motor at a normal operating speed that corresponds to said rated operating rpm immediately after said main drive shaft is coupled to said flywheel mass.

22. The method according to claim 16 further comprising the step of switching on said electric motor at a normal operating speed that corresponds to said rated operating rpm when said main drive shaft has reached an intermediate rpm that is intermediate to said rated operating rpm and said start-up rpm.

23. The method according to claim 16, wherein said start-up rpm is so calculated that said main drive shaft is rotating with a beat-up rpm that is higher than said rated operating rpm at said first beat-up time.

* * * * *

UNITED STATES PATENT AND TRADEMARK OFFICE

CERTIFICATE OF CORRECTION

PATENT NO. : 6,307,340 B1
DATED : October 23, 2001
INVENTOR(S) : Wagner et al.

It is certified that error appears in the above-identified patent and that said Letters Patent is hereby corrected as shown below:

Title page,
Item [73], Assignee, Line 2, before "(DE)", insert -- Lindau --.

Column 3,
Line 66, after "the", delete "M".

Column 4,
Line 53, after "line", replace "anw" by -- Δnw --.

Column 5,
Line 6, after "within", replace "+4%" by -- ±4% --.

Column 7,
Line 17, before "at", replace "cage" by -- case --;
Line 31, after "operating", replace "rim ni" by -- rpm n1 --.

Column 8,
Line 4, after "data", replace "get" by -- set --.

Signed and Sealed this

Ninth Day of April, 2002

*Attest:*

*Attesting Officer*

JAMES E. ROGAN
*Director of the United States Patent and Trademark Office*